US010960422B2

(12) United States Patent
Zhu

(10) Patent No.: US 10,960,422 B2
(45) Date of Patent: Mar. 30, 2021

(54) PUMP ASSEMBLY AND CONTAINER WITH CONTENTS DISCHARGE FUNCTION

(71) Applicant: NUBIZ PLASTIC (NANTONG) CO., LTD, Qidong (CN)

(72) Inventor: Wei Zhu, Qidong (CN)

(73) Assignee: Nubiz Plastic (Nantong) Co., Ltd., Quidong (CN)

( * ) Notice: Subject to any disclaimer, the term of this patent is extended or adjusted under 35 U.S.C. 154(b) by 0 days.

(21) Appl. No.: 16/742,560

(22) Filed: Jan. 14, 2020

(65) Prior Publication Data

US 2020/0222928 A1 Jul. 16, 2020

(30) Foreign Application Priority Data

Jan. 15, 2019 (CN) ..... 201910036365.2

(51) Int. Cl.
*B05B 11/00* (2006.01)

(52) U.S. Cl.
CPC ..... *B05B 11/3038* (2013.01); *B05B 11/0078* (2013.01); *B05B 11/3001* (2013.01); *B05B 11/3052* (2013.01); *B05B 11/3067* (2013.01)

(58) Field of Classification Search
CPC ..... B05B 11/3038; B05B 11/3001; B05B 11/3052; B05B 11/3067; B05B 11/0089; B05B 11/3023; B05B 11/3078; B65D 47/30; B65D 2547/063
USPC ..... 222/321.7, 321.9, 336
See application file for complete search history.

(56) References Cited

U.S. PATENT DOCUMENTS 3,463,093 A * 8/1969 Pilz ..... B05B 11/3026 417/547
3,500,761 A * 3/1970 Waters ..... F04B 53/121 417/513
4,132,332 A * 1/1979 Wassilieff ..... B05B 9/0838 141/3

(Continued)

FOREIGN PATENT DOCUMENTS

CN 1159416 A 9/1997
CN 2490102 Y 5/2002

(Continued)

OTHER PUBLICATIONS

PCT International Search Report and Written Opinion, PCT/CN2020/071433, dated Apr. 15, 2020, 12 pages [English language translation of "Citation and Explanation", p. 4, Form 237 attached].

*Primary Examiner* — Paul R Durand
*Assistant Examiner* — Randall A Gruby
(74) *Attorney, Agent, or Firm* — Quarles & Brady LLP

(57) ABSTRACT

A pump assembly comprises a pump main body having a first cavity and a press rod. The press rod has a rod body and a piston portion in which the rod body is slidably provided in the first cavity in a penetrating manner and one end thereof extends out of the first cavity. The piston portion is connected to the rod body and is located in the first cavity to divide it into a first gas cavity and a second gas cavity, one or more of which are sealed cavities. Since the piston portion can rebound under the resultant force of a gas pressure in the gas cavities, the pump main body does not need a spring for rebounding the rod body. Accordingly, the pump assembly can be entirely made of a plastic material, and no metal material is mixed, so the pump assembly is easily recycled.

17 Claims, 15 Drawing Sheets

(56) References Cited

U.S. PATENT DOCUMENTS 5,363,993 A * 11/1994 Mascitelli ..... B05B 11/0013 222/153.09
5,881,927 A * 3/1999 Inagawa ..... B05B 11/3078 222/321.7
6,105,830 A * 8/2000 Inagawa ..... B05B 11/3001 222/321.9
6,672,486 B2 * 1/2004 Santagiuliana ..... B05B 11/3007 222/207
6,923,346 B2 * 8/2005 Foster ..... B05B 7/0031 222/145.5
6,966,465 B2 * 11/2005 Kang, III ..... B05B 11/3001 222/321.9
7,243,821 B2 * 7/2007 Bougamont ..... B05B 11/3026 222/321.5
7,934,626 B2 * 5/2011 Choi ..... A45D 34/04 222/320
8,672,190 B1 * 3/2014 Wang ..... B05B 11/0008 222/153.13
9,669,418 B2 * 6/2017 Kang ..... F04B 53/10
2007/0164055 A1 * 7/2007 Tsai ..... B05B 11/061 222/401
2007/0221686 A1 * 9/2007 Bae ..... A45D 34/02 222/409
2008/0093389 A1 * 4/2008 Vasseur ..... B05B 11/0072 222/321.9
2011/0278328 A1 * 11/2011 Kang ..... B05B 11/3076 222/340
2013/0140332 A1 * 6/2013 Csaszar ..... B05B 11/0008 222/256

FOREIGN PATENT DOCUMENTS

CN 104058163 A 9/2014
CN 105517914 A 4/2016
CN 109649819 A 4/2019
CN 110155489 A 8/2019
CN 209366849 U 9/2019
CN 209650898 U 11/2019
CN 210140105 U 3/2020
JP H09301453 A 11/1997

* cited by examiner

PUMP ASSEMBLY AND CONTAINER WITH CONTENTS DISCHARGE FUNCTION

CROSS-REFERENCE TO RELATED APPLICATIONS

This application claims priority to Chinese Patent Application No. 201910036365.2 filed Jan. 15, 2019, the disclosure of which is hereby incorporated by reference for all purposes.

STATEMENT CONCERNING FEDERALLY SPONSORED RESEARCH OR DEVELOPMENT

Not applicable.

TECHNICAL FIELD

The present disclosure relates to a pump assembly and a container with a contents discharge function.

BACKGROUND

Containers with a contents discharge function are often used in daily life, such as bottles containing contents such as cosmetics, shampoos, detergents, or medicines. Such a container with a contents discharge function comprises a container body, a pump assembly, a cap, and an extension pipe.

The container body has a liquid filling port for filling contents. The pump assembly comprises a pump main body and a press rod, wherein the pump main body is detachably provided in the liquid filling port in a penetrating manner, the press rod is mounted on the pump main body and an upper end thereof protrudes from the pump main body, and the cap is mounted to an upper end of the press rod. One end of the extension pipe is connected to the pump main body, and the other end thereof extends to below the liquid level of the contents.

The cap is configured to be pressed by a user, so as to press the press rod down relative to the pump main body, such that the contents remaining in the pump main body can be discharged from the pump main body through channels inside the press rod and the cap. After the press rod is pressed down in place, the press rod needs to rebound such that the press rod is adapted to be re-pressed, and during the rebounding process, the press rod can also drive the pump main body to suck in the contents from the container body through the extension pipe. In the prior art, a spring is provided inside the pump main body, and the press rod compresses the spring during the pressing-down process. When the external force is removed, the spring enables the press rod to rebound. For the working principle of the aforementioned pump assembly with a spring, reference can be made to the disclosure in patent document CN 105517914 A.

In the prior art, since the spring is made of a metal material, parts of the pump assembly except the spring are made of plastic materials, which poses a problem for recycling the pump assembly as garbage. Most countries' garbage recycling standards require that plastic and metal be recycled separately. However, when the aforementioned pump assembly is recycled as garbage, the spring is not easily removed because it is tightly mounted inside the pump main body. As a result, the pump assembly in the prior art is not easily recycled but can only be discarded as waste.

SUMMARY

The present disclosure provides a pump assembly, which has the advantage of being easily recycled.

Additionally, the present disclosure provides a container with a contents discharge function, comprising the pump assembly described above.

A pump assembly for achieving the object is adapted to be mounted on a container body, and comprises a pump main body and a press rod, wherein the press rod has a rod body and a piston portion; the pump main body has a first cavity; the rod body is slidably provided in the first cavity in a penetrating manner, and one end thereof extends out of the first cavity; the piston portion is connected to the rod body and is located in the first cavity so as to divide the first cavity into a first gas cavity and a second gas cavity, wherein the first gas cavity and/or the second gas cavity are sealed cavities; the rod body is configured to be pressed to drive the piston portion to expand the first gas cavity and compress the second gas cavity; and the piston portion is configured to rebound under the action of the resultant force of a gas pressure in the first gas cavity and a gas pressure in the second gas cavity, so as to drive the rod body to rebound, such that the rod body is adapted to be re-pressed.

In one embodiment, the first gas cavity is a sealed cavity; the pump main body further has a gas guide channel, wherein the gas guide channel is in communication with the second gas cavity; and a gas is discharged from or sucked into the second gas cavity through the gas guide channel.

In one embodiment, the pump main body comprises an outer housing and an inner housing; the outer housing surrounds the inner housing, an inner wall of the inner housing defines the first cavity, and the piston portion is in a sliding fit with the inner wall of the inner housing; the inner housing is provided with a first access hole, the first access hole being in communication with the first cavity; the rod body is slidably provided in the first access hole in a penetrating manner; and an outer wall of the inner housing is fitted to an inner wall of the outer housing in a surface-to-surface contact manner, wherein the inner wall of the outer housing is recessed to form the gas guide channel.

In one embodiment, the inner housing has a top wall and a side wall, the top wall and the side wall defining the first cavity; the piston portion is in a sliding fit with an inner wall of the side wall, and an outer wall of the side wall is fitted to the inner wall of the outer housing in a surface-to-surface contact manner; and the top wall has the first access hole.

In one embodiment, the pump main body further comprises a sealing ring and a press cover; the sealing ring has an assembling hole, and the press cover has a second access hole; the inner housing is further provided with an annular wall, the annular wall being provided on an outer wall of the top wall in a protruding manner and surrounding the first access hole; the annular wall defines an accommodation cavity, the accommodation cavity being in communication with the first access hole; the sealing ring is arranged in the accommodation cavity, and the assembling hole and the rod body are in a shaft-hole fit; the rod body is slidably provided in the second access hole in a penetrating manner; and the press cover is connected to the outer housing, to press the sealing ring against the top wall such that the sealing ring seals a gap between the first access hole and the rod body.

In one embodiment, the pump main body further comprises a piston; the outer housing has a first housing portion and a second housing portion; the first housing portion surrounds the inner housing, the outer wall of the inner housing is fitted to an inner wall of the first housing portion in a surface-to-surface contact manner, and the inner wall of the first housing portion is recessed to form the gas guide channel; an inner wall of the second housing portion defines a second cavity; the piston is arranged in the second cavity, and is in a sliding fit with the inner wall of the second housing portion; the other end of the rod body extends into the second cavity; and the rod body is configured to drive the piston to slide in the second cavity.

In one embodiment, the pump main body further comprises a valve; the second housing portion has an opening, the opening being in communication with the second cavity; and the valve covers the opening, allowing the second cavity to suck in the contents from the container body through the opening in one direction.

In one embodiment, the piston has a through hole, and the rod body has a discharge channel, the discharge channel penetrating the rod body; the discharge channel is in communication with the through hole; and the piston is configured to press the contents from the second cavity into the through hole, and discharge the contents out of the second cavity through the discharge channel.

In one embodiment, the pump main body further comprises a seat, the seat having a flow guide portion and a seat portion, wherein the flow guide portion is connected to the rod body, and the seat portion is provided in the second cavity; the flow guide portion has a flow guide channel, one end of the flow guide channel is in communication with the discharge channel, and the other end thereof is in communication with the through hole; and the piston is slidably arranged on the rod body, wherein the piston is capable of sliding on the rod body in a direction away from the seat portion, so as to be separated from the seat portion, such that the through hole is opened; and the piston is also capable of sliding on the rod body in a direction close to the seat portion, so as to abut against the seat portion, such that the through hole is closed.

A container with a contents discharge function for achieving the further object comprises a container body and further comprises a pump assembly as described above, the pump assembly being mounted on the container body and configured to discharge contents of the container body.

The positive and progressive effects of the present disclosure are as follows: in the pump assembly of the present disclosure, since the piston portion can rebound under the action of the resultant force of the gas pressure in the first gas cavity and the gas pressure in the second gas cavity, so as to drive the rod body to rebound, the pump main body does not need to be provided with a spring for rebounding the rod body. As a result, the pump assembly can be entirely made of a plastic material, and no metal material is mixed, so that the pump assembly is easily recycled. The container with a contents discharge function provided in the present disclosure comprises the pump assembly described above.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

The above and other features, properties and advantages of the present invention will become more apparent from the following description of embodiments with reference to the accompany drawings, in which.

DETAILED DESCRIPTION OF THE PREFERRED EMBODIMENT

Figure 1:
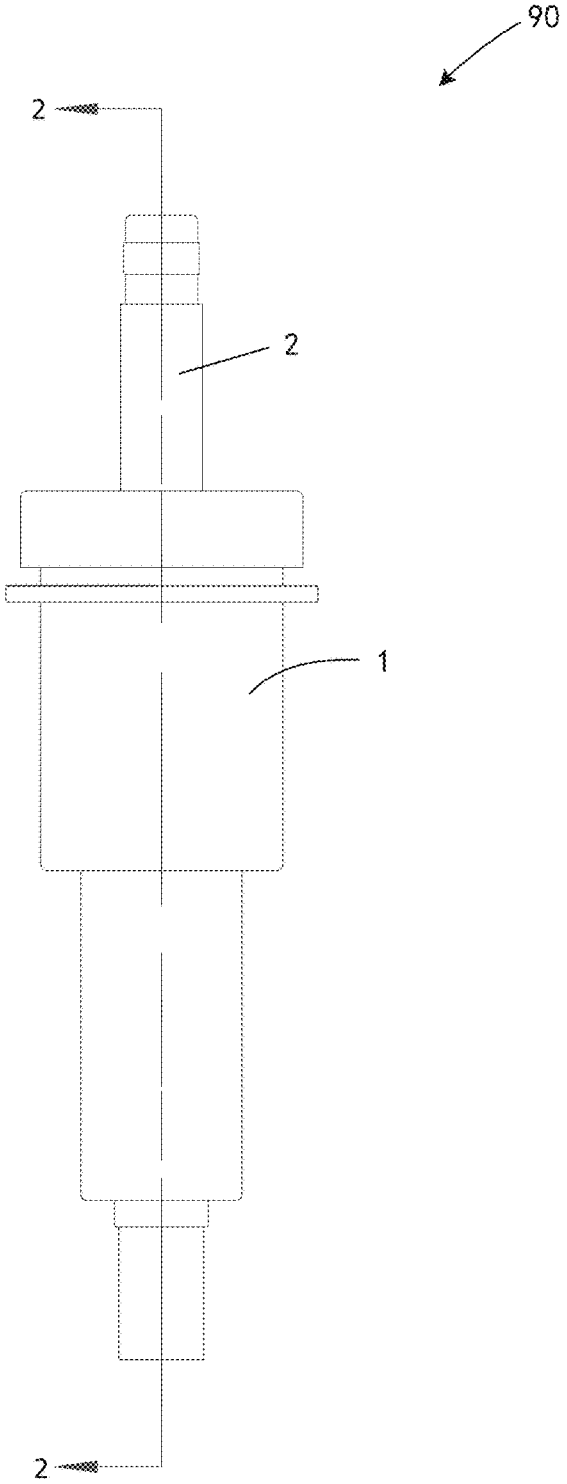
FIGS. 1, 2 and 3 are respectively a front view, a sectional view in a direction of 2-2 of FIG. 1, and an exploded view of a pump assembly.

The present invention will be further described below in conjunction with particular embodiments and the accompanying drawings, and more details are explained in the following description for the ease of fully understanding the present invention; however, the present invention can obviously be implemented in various different manners than that described herein, a person skilled in the art can make an similar extension and deduction without departing from the connotation of the present invention according to the practical applications, and therefore the scope of protection of the present invention should not be limited to the content of the particular embodiments herein.

Various implementations or embodiments of the technical solutions of the implemented subject matter are disclosed below. To simplify the disclosure, specific instances of each element and arrangement are described below. Of course, these instances are merely examples, and are not intended to limit the scope of protection of the present invention. For example, a first feature recorded later in the specification being formed above or over a second feature can include an implementation of forming a direct contact of the first and second features, and can also include an implementation of forming an additional feature between the first feature and the second feature such that the first and second features may not be in direct contact. Additionally, reference numerals and/or letters may be repeated in different examples in these disclosures. This repetition is for the sake of brevity and clarity, and does not itself represent the relationship between the various implementations and/or structures to be discussed. Further, when a first element is described in connection with or in combination with a second element, the description includes an implementation in which the first and second elements are directly connected or combined to each other, and also includes the use of one or more other intervening elements such that the first and second elements are indirectly connected or combined to each other.

It should be noted that FIGS. 1 to 34 are merely used as examples, and are not necessarily drawn to scale, and should not be taken as a limitation to the actually claimed scope of protection of the present invention.

Figure 34:
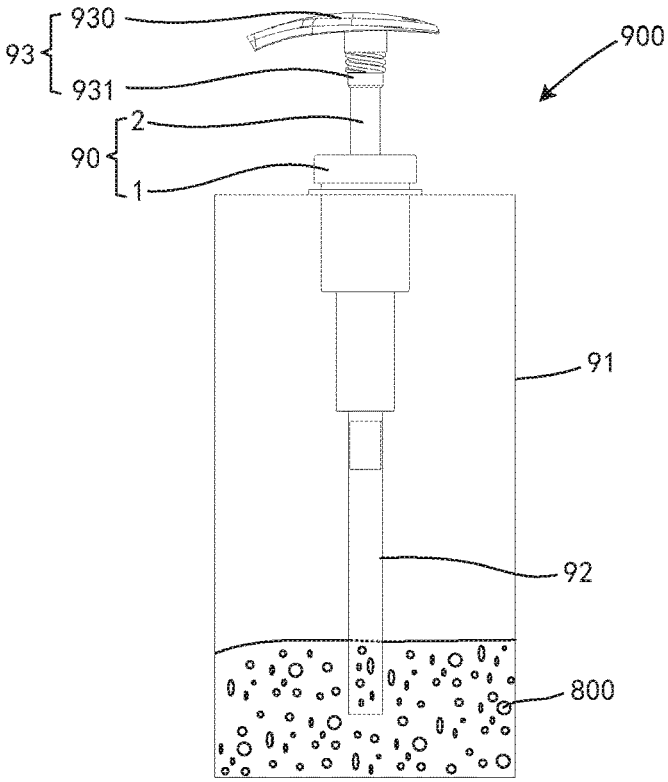
FIG. 34 is a schematic view of a container with a contents discharge function.

Referring first to FIG. 34, a container 900 with a contents discharge function comprises a container body 91, a pump assembly 90, a cap 93, and an extension pipe 92.

The container body 91 has a liquid filling port for filling contents 800. The pump assembly 90 comprises a pump main body 1 and a press rod 2. The pump main body 1 is detachably provided in the liquid filling port in a penetrating manner. The press rod 2 is pressably mounted on the pump main body 1 and an upper end thereof protrudes from the pump main body 1. The cap 93 is mounted to an upper end of the press rod 2. One end of the extension pipe 92 is connected to the pump main body 1, and the other end thereof extends to below the liquid level of the contents 800.

The cap 93 is configured to be pressed by a user, so as to press the press rod 2 down relative to the pump main body 1, such that the contents remaining in the pump main body 1 can be discharged from the pump main body 1 through channels inside the press rod 2 and the cap 93. After the press rod 2 is pressed down in place, the press rod 2 needs to rebound such that the press rod 2 is adapted to be re-pressed, and during the rebounding process, the press rod 2 can also drive the pump main body 1 to suck in the contents 800 from the container body 91 through the extension pipe 92.

Figure 2:
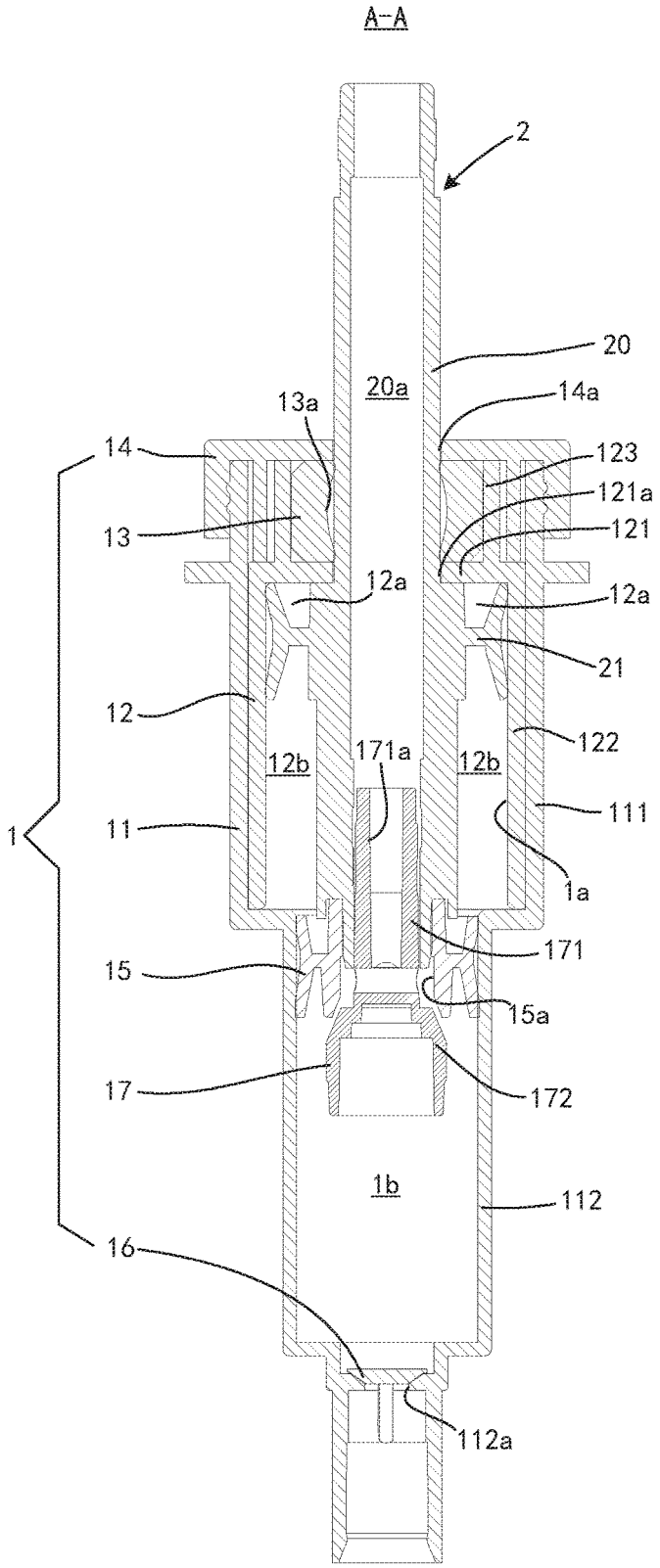
Figure 3:
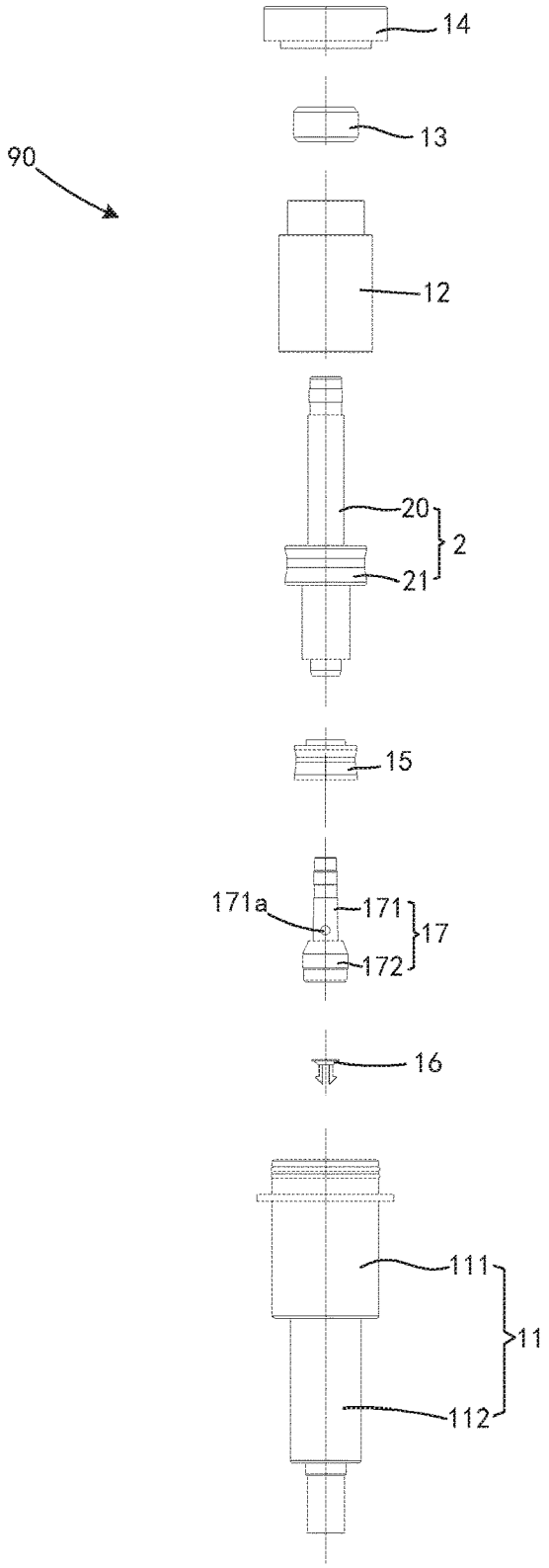

In order to rebound the press rod 2, as shown in FIGS. 1, 2 and 3, in one embodiment, the press rod 2 has a rod body 20 and a piston portion 21. The pump main body 1 has a first cavity 1*a*. The rod body 20 is slidably provided in the first cavity 1*a* in a penetrating manner, and one end thereof extends out of the first cavity 1*a*. The piston portion 21 is connected to the rod body 20 and is located in the first cavity 1*a* so as to divide the first cavity 1*a* into a first gas cavity 12*a* and a second gas cavity 12*b*, wherein the first gas cavity 12*a* and/or the second gas cavity 12*b* are sealed cavities. The rod body 20 is configured to be pressed to drive the piston portion 21 to expand the first gas cavity 12*a* and compress the second gas cavity 12*b*. The piston portion 21 is configured to rebound under the action of the resultant force of a gas pressure in the first gas cavity 12*a* and a gas pressure in the second gas cavity 12*b*, so as to drive the rod body 20 to rebound, such that the rod body 20 is adapted to be re-pressed. The pressing-down and rebounding processes of the press rod 2 will be described in detail later.

A gas, such as air, is present in both the first gas cavity 12*a* and the second gas cavity 12*b*. During the pressing-down process, the rod body 20 drives the piston portion 21 to move within the first cavity 1*a*, such that the volume of the first gas cavity 12*a* increases (that is, the first gas cavity 12*a* is expanded), and the volume of the second gas cavity 12*b* decreases (that is, the second gas cavity 12*b* is compressed).

The first gas cavity 12*a* and/or the second gas cavity 12*b* being sealed cavities includes three specific embodiments: the first gas cavity 12*a* and the second gas cavity 12*b* are both sealed cavities; the first gas cavity 12*a* is an unsealed cavity (e.g., in communication with the atmosphere), and the second gas cavity is a sealed cavity; and the first gas cavity 12*a* is a sealed cavity, and the second gas cavity 12*b* is an unsealed cavity (e.g., in communication with the atmosphere).

In the first embodiment described above, as the rod body 20 is pressed down, the gas pressure in the first gas cavity 12*a* decreases, and the gas pressure in the second gas cavity 12*b* increases. As a result, the gas pressure in the first gas cavity 12*a* is smaller than the gas pressure in the second gas cavity 12*b*, so that the piston portion 21 can rebound under the action of the resultant force of the gas pressure in the first gas cavity 12*a* and the gas pressure in the second gas cavity 12*b*, so as to drive the rod body 20 to rebound. In this embodiment, neither the first gas cavity 12*a* nor the second gas cavity 12*b* is in gas communication with the outside.

In the second embodiment described above, as the rod body 20 is pressed down, the gas pressure in the first gas cavity 12*a* can remain unchanged and can always be equal to the pressure of the atmosphere, and the gas pressure in the second gas cavity 12*b* increases. As a result, the gas pressure in the first gas cavity 12*a* is smaller than the gas pressure in the second gas cavity 12*b*, so that the piston portion 21 can rebound under the action of the resultant force of the gas pressure in the first gas cavity 12*a* and the gas pressure in the second gas cavity 12*b*, so as to drive the rod body 20 to rebound. In this embodiment, the first gas cavity 12*a* is in gas communication with the outside, and the second gas cavity 12*b* is not in gas communication with the outside.

In the third embodiment described above, as the rod body 20 is pressed down, the gas pressure in the first gas cavity 12*a* decreases, and the gas pressure in the second gas cavity 12*b* can remain unchanged and can always be equal to the pressure of the atmosphere. As a result, the gas pressure in the first gas cavity 12*a* is smaller than the gas pressure in the second gas cavity 12*b*, so that the piston portion 21 can rebound under the action of the resultant force of the gas pressure in the first gas cavity 12*a* and the gas pressure in the second gas cavity 12*b*, so as to drive the rod body 20 to rebound. In this embodiment, the rod body 20 is easily pressed down in place, which can improve the user's use experience. In this embodiment, the second gas cavity 12*b* is in gas communication with the outside, and the first gas cavity 12*a* is not in gas communication with the outside. In this embodiment, as shown in FIGS. 24A, 24B, 24C, 24D and 24E, the pump main body 1 further has a gas guide channel 111*a*, wherein the gas guide channel 111*a* is in communication with the second gas cavity 12*b*; and the gas is discharged from or sucked into the second gas cavity 12*b* through the gas guide channel 111*a*. A path for the second gas cavity 12*b* to suck in the gas through the gas guide channel 111*a* is shown by the dashed arrows in FIGS. 24D and 24E. A path for the second gas cavity 12*b* to discharge the gas through the gas guide channel 111*a* is opposite to that shown by the dashed arrows. In this embodiment, when the press rod 2 is pressed down, air can be discharged from the second gas cavity 12*b* quickly and smoothly, thereby reducing the resistance to the downward pressing. When the press rod 2 rebounds, the air can flow into the cavity 12*b* quickly and smoothly, so that the rebounding is smoother.

In the various embodiments described above, since the piston portion 21 can rebound under the action of the resultant force of the gas pressure in the first gas cavity 12*a* and the gas pressure in the second gas cavity 12*b*, so as to drive the rod body 20 to rebound, the pump main body 1 does not need to be provided with a spring for rebounding the rod body 20. As a result, the pump assembly 90 can be entirely made of a plastic material, and no metal material is mixed, so that the pump assembly 90 is easily recycled.

With continued reference to FIG. 2, in a more specific embodiment, the pump main body 1 comprises an outer housing 11 and an inner housing 12. The outer housing 11 surrounds the inner housing 12, an inner wall of the inner housing 12 defines the first cavity 1*a*, and the piston portion 21 is in a sliding fit with the inner wall of the inner housing 12. The inner housing 12 is provided with a first access hole 121*a*. The first access hole 121*a* is in communication with the first cavity 1*a*. The rod body 20 is slidably provided in the first access hole 121*a* in a penetrating manner. An outer wall of the inner housing 12 is fitted to an inner wall of the outer housing 11 in a surface-to-surface contact manner, wherein the inner wall of the outer housing 11 is recessed to form the gas guide channel 111*a*. Such a solution enables the firm structure of the pump main body 1.

Figure 4:
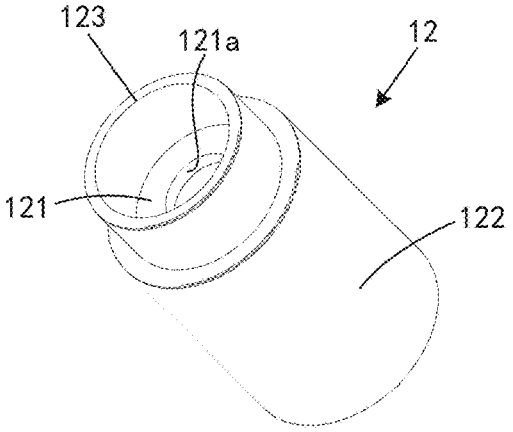
FIGS. 4, 5 and 6 are respectively a schematic view, a front view, and a sectional view in a direction of 6-6 of FIG. 5 of an inner housing.
Figure 5:
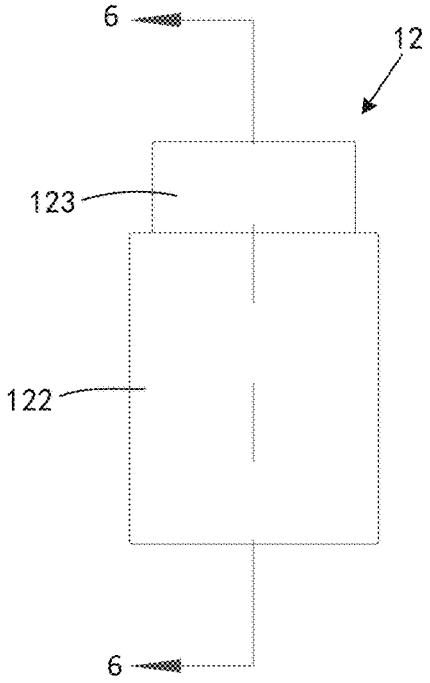
Figure 6:
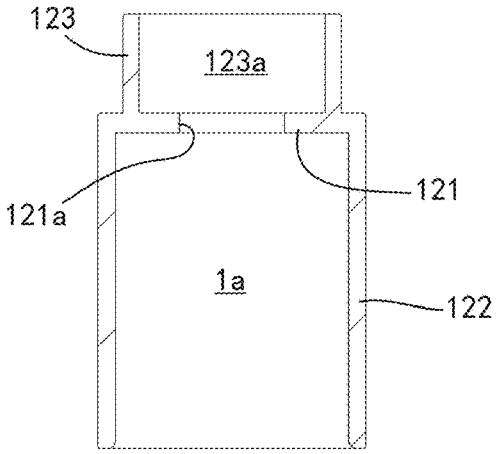
Figure 7:
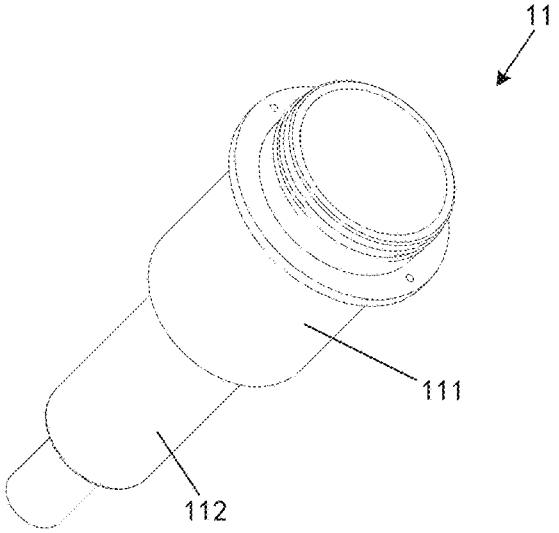
FIGS. 7, 8 and 9 are respectively a schematic view, a front view, and a sectional view in a direction of 9-9 of FIG. 8 of an outer housing.
Figure 8:
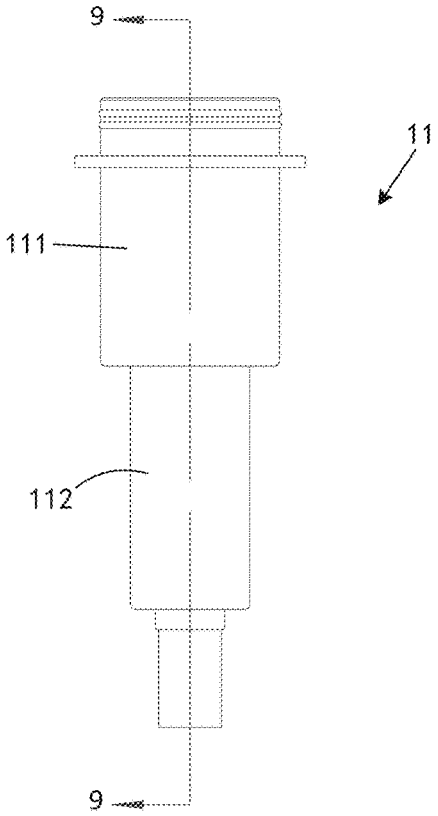
Figure 9:
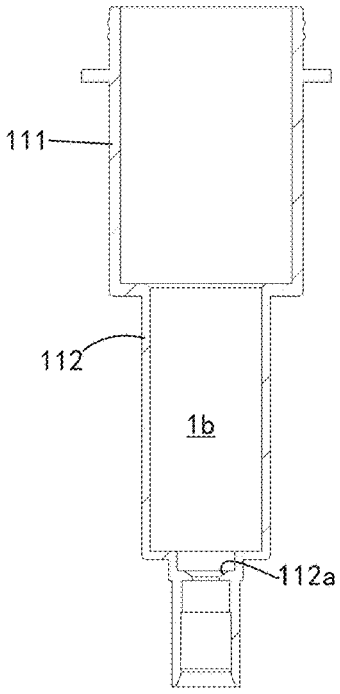
Figure 10:
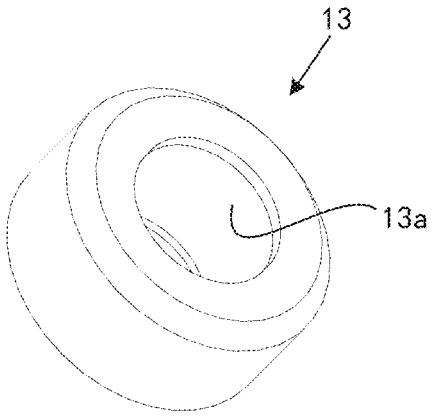
FIG. 10 is a schematic diagram of a sealing ring.
Figure 11:
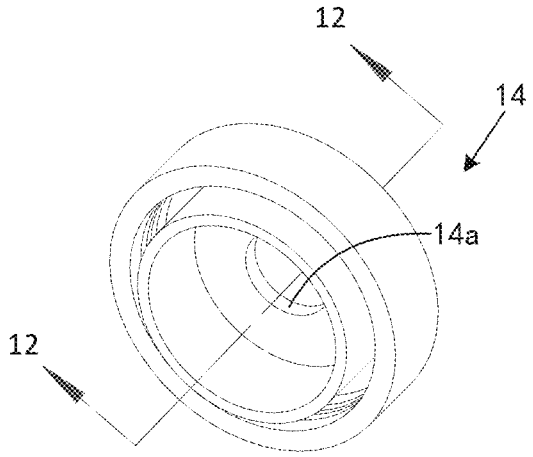
FIGS. 11 and 12 are respectively a schematic view and a sectional view of a press cover in a direction 12-12 of FIG. 11.
Figure 12:
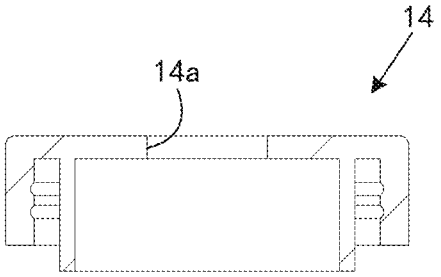
Figure 13:
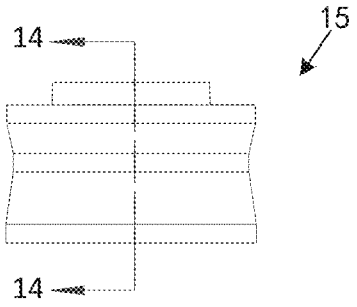
FIGS. 13 and 14 are respectively a front view and a sectional view of a piston in a direction 14-14 of FIG. 13.
Figure 14:
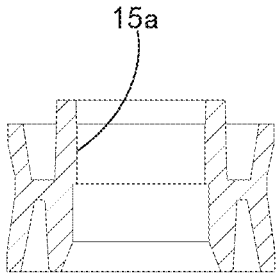

As shown in FIGS. 4, 5 and 6, the inner housing 12 has a top wall 121 and a side wall 122. The top wall 121 and the side wall 122 define the first cavity 1*a*. The piston portion 21 is in a sliding fit with an inner wall of the side wall 122, and an outer wall of the side wall 122 is fitted to the inner wall of the outer housing 11 in a surface-to-surface contact manner. The top wall 121 has the first access hole 121*a*. Such a solution enables the inner housing 12 to be easily mounted in the outer housing 11 without shaking.

As shown in FIGS. 2, 10, 11 and 12, the pump main body 1 further comprises a sealing ring 13 and a press cover 14. The sealing ring 13 has an assembling hole 13*a*, and the press cover 14 has a second access hole 14*a*. The inner housing 12 is further provided with an annular wall 123. The annular wall 123 is provided on an outer wall of the top wall 121 in a protruding manner and surrounds the first access hole 121*a*. The annular wall 123 defines an accommodation cavity 123*a*. The accommodation cavity 123*a* is in communication with the first access hole 121*a*. The sealing ring 13 is arranged in the accommodation cavity 123*a*, and the assembling hole 13*a* and the rod body 20 are in a shaft-hole fit. The rod body 20 is slidably provided in the second access hole 14*a* in a penetrating manner. The press cover 14 is connected to the outer housing 11, to press the sealing ring 13 against the top wall 121 such that the sealing ring 13 seals a gap between the first access hole 121*a* and the rod body 20. Such a solution enables the improved sealing performance and firmness of the pump main body 1.

As shown in FIGS. 2, 7, 8, 9, 13 and 14, the pump main body 1 further comprises a piston 15. The outer housing 11 has a first housing portion 111 and a second housing portion 112. The first housing portion 111 surrounds the inner housing 12, the outer wall of the inner housing 12 is fitted to an inner wall of the first housing portion 111 in a surface-to-surface contact manner, and the inner wall of the first housing portion 111 is recessed to form the gas guide channel 111*a*. An inner wall of the second housing portion 112 defines a second cavity 1*b*. The piston 15 is arranged in the second cavity 1*b*, and is in a sliding fit with the inner wall of the second housing portion 112. The other end of the rod body 20 extends into the second cavity 1*b*. The rod body 20 is configured to drive the piston 15 to slide in the second cavity 1*b*. Such a solution enables the compact structure of the pump main body 1.

Figure 15:
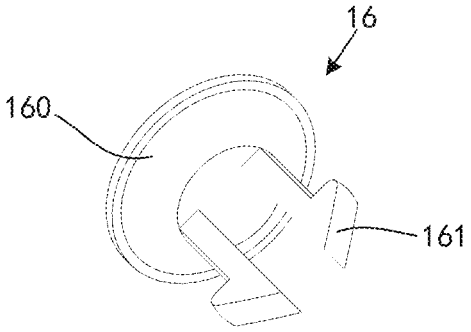
FIGS. 15 and 16 are respectively a schematic view and a front view of a valve.
Figure 16:
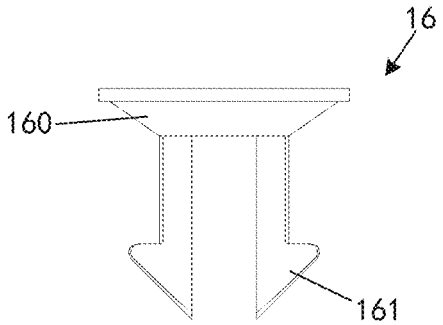

As shown in FIGS. 2, 15 and 16, the pump main body 1 further comprises a valve 16. The second housing portion 112 has an opening 112*a*. The opening 112*a* is in communication with the second cavity 1*b*. The valve 16 covers the opening 112*a*, allowing the second cavity 1*b* to suck in the contents 800 from the container body 91 through the opening 112*a* in one direction. The valve 16 comprises a tapered body 160 and a hook 161. The tapered body 160 covers the opening 112*a* on one side thereof, and the hook 161 passes through the opening 112*a* and is retained on the other side of the opening 112*a* to prevent the valve 16 from falling off the opening 112*a*. The opening 112*a* has a tapered face, and the tapered body 160 is in a taper fit with the tapered face to achieve a one-way opening function of the opening 112*a*.

As shown in FIGS. 2, 13, 14, 17, 18 and 19, the piston 15 has a through hole 15*a*, and the rod body 20 has a discharge channel 20*a*. The discharge channel 20*a* penetrates the rod body 20. The discharge channel 20*a* is in communication with the through hole 15*a*. The piston 15 is configured to press the contents 800 from the second cavity 1*b* into the through hole 15*a*, and discharge the contents out of the second cavity 1*b* through the discharge channel 20*a*. Such a solution provides a method for discharging the contents 800 from the second cavity 1*b*.

As shown in FIGS. 2, 20, 21 and 22, the pump main body 1 further comprises a seat 17. The seat 17 has a flow guide portion 171 and a seat portion 172. The flow guide portion 171 is connected to the rod body 20, and the seat portion 172 is provided in the second cavity 1*b*. The flow guide portion 171 has a flow guide channel 171*a*. One end of the flow guide channel 171*a* is in communication with the discharge channel 20*a*, and the other end thereof is in communication with the through hole 15*a*. The piston 15 is slidably arranged on the rod body 20, wherein the piston 15 can slide on the rod body 20 in a direction away from the seat portion 172, so as to be separated from the seat portion 172, such that the through hole 15*a* is opened; and the piston 15 can also slide on the rod body 20 in a direction close to the seat portion 172, so as to abut against the seat portion 172, such that the through hole 15*a* is closed.

Figure 17:
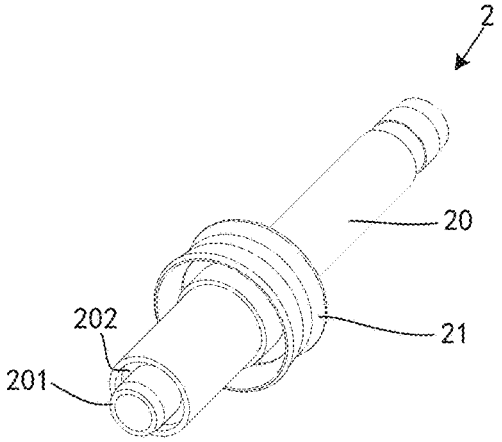
FIGS. 17, 18 and 19 are respectively a schematic view, a front view, and a sectional view in a direction of 19-19 of FIG. 18 of a press rod.
Figure 18:
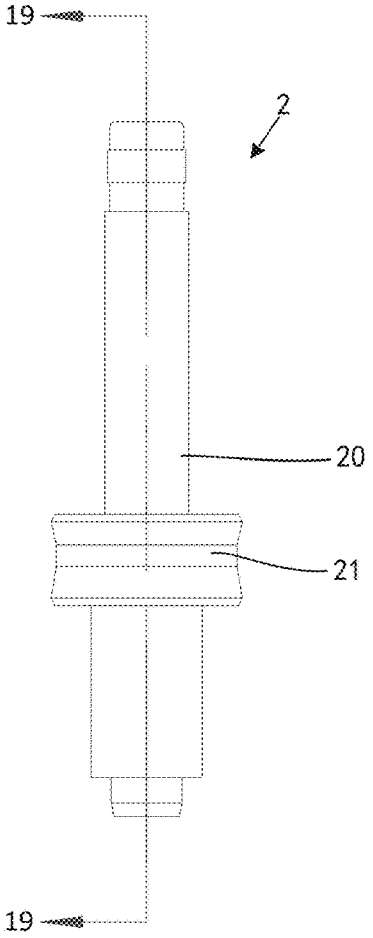
Figure 19:
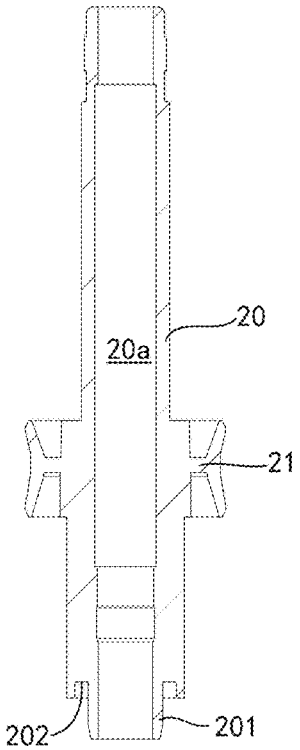
Figure 20:
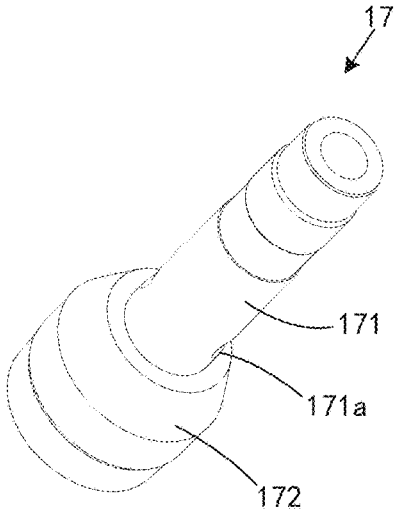
FIGS. 20, 21 and 22 are respectively a schematic view, a front view, and a sectional view in a direction of 22-22 of FIG. 21 of a seat.
Figure 21:
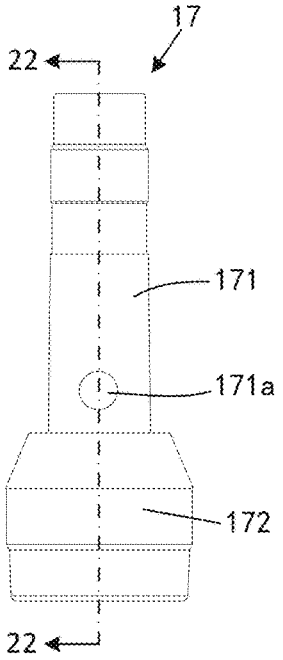
Figure 22:
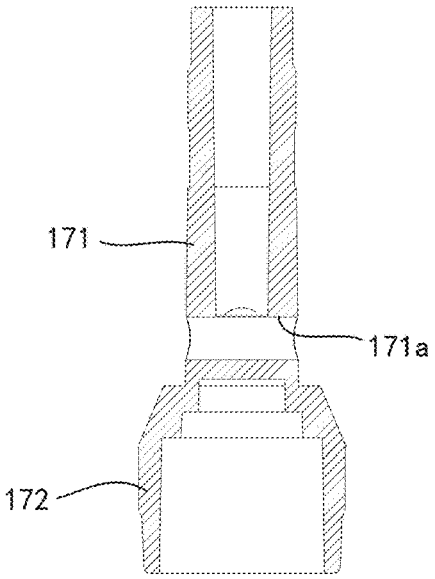

As shown in FIGS. 17 and 19, the end of the rod body 20 that is in contact with the piston 15 has a protruding column 201 and a limiting face 202. The limiting face 202 is arranged around the protruding column 201. An inner wall of the protruding column 201 defines an entrance of the discharge channel 20*a*, and an outer wall of the protruding column 201 is in a slidable shaft-hole fit with the through hole 15*a* of the piston 15. The limiting face 202 is configured to abut against the piston 15 to limit the sliding of the piston 15 on the protruding column 201 in the direction away from the seat portion 172. The seat portion 172 is configured to abut against the piston 15 to limit the sliding of the piston 15 on the protruding column 201 in the direction close to the seat portion 172.

Figure 23A:
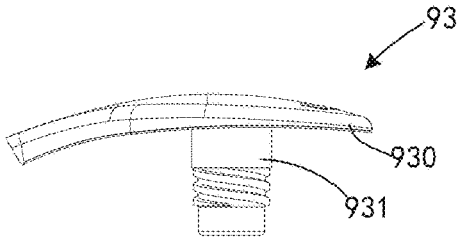
FIGS. 23A and 23B are respectively a front view and a sectional view of a cap taken centrally through the cap of FIG. 23A.
Figure 23B:
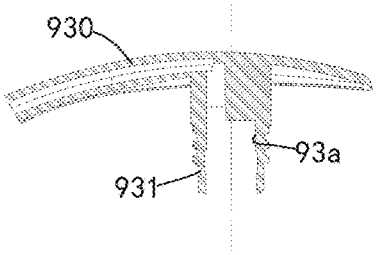
Figure 24A:
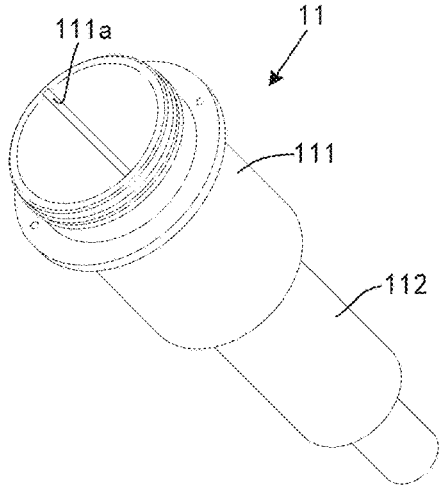
FIG. 24A is a schematic view of the outer housing, showing a gas guide channel.
Figure 24B:
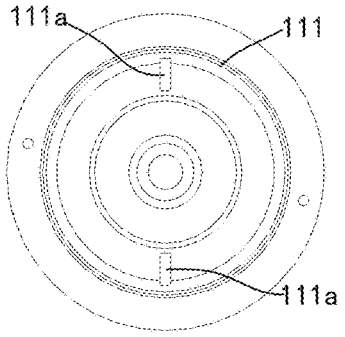
FIG. 24B is a top view of the outer housing, showing two gas guide channels.
Figure 24C:
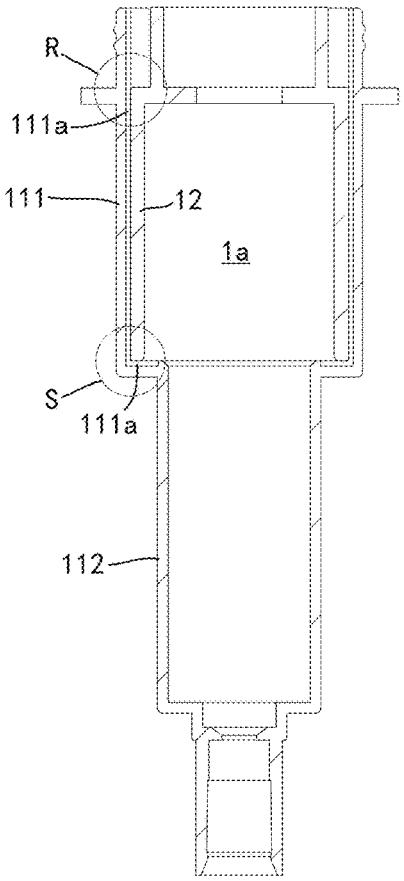
FIG. 24C is a sectional view of the outer housing and the inner housing after assembly.
Figure 24D:
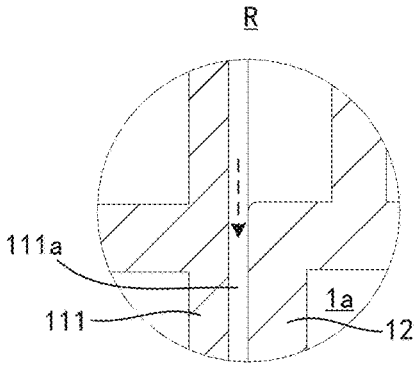
FIG. 24D is an enlarged view of part R in FIG. 24C.
Figure 24E:
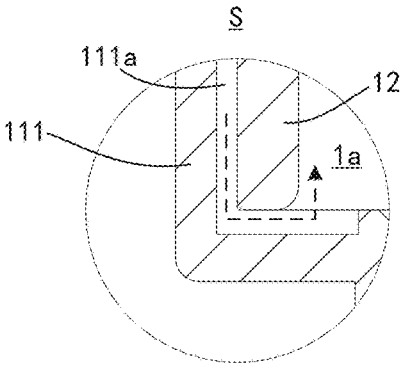
FIG. 24E is an enlarged view of part S in FIG. 24C.

The specific structure of the cap 93 is shown in FIGS. 23A and 23B. The cap 93 comprises a cap body 930 and a connection portion 931. A dispensing channel 93*a* is formed inside the cap 93. The dispensing channel 93*a* penetrates the cap body 930 and the connection portion 931. As shown in FIG. 34, the connection portion 931 is connected to the press rod 2. The dispensing channel 93*a* is in communication with the discharge channel 20*a*.

FIGS. 25, 26, 27, 28, 29, 30, 31, 32 and 34 show the pressing-down and rebounding processes of the press rod 2.

The pressing-down and rebounding processes of the press rod 2 are described below by taking the case where the first gas cavity 12*a* is a sealed cavity and the second gas cavity 12*b* is in communication with the atmosphere through the gas guide channel 111*a* as an example.

Figure 25:
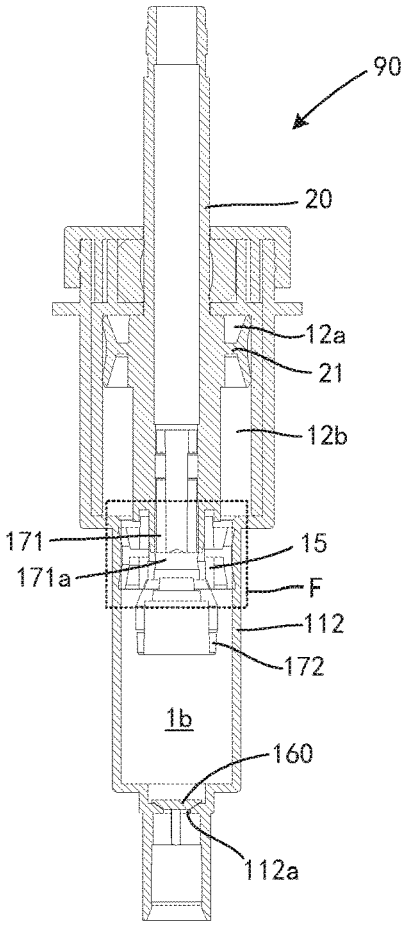
FIG. 25 is a sectional view of the pump assembly, in which the press rod is in a pressing-down start position.
Figure 26:
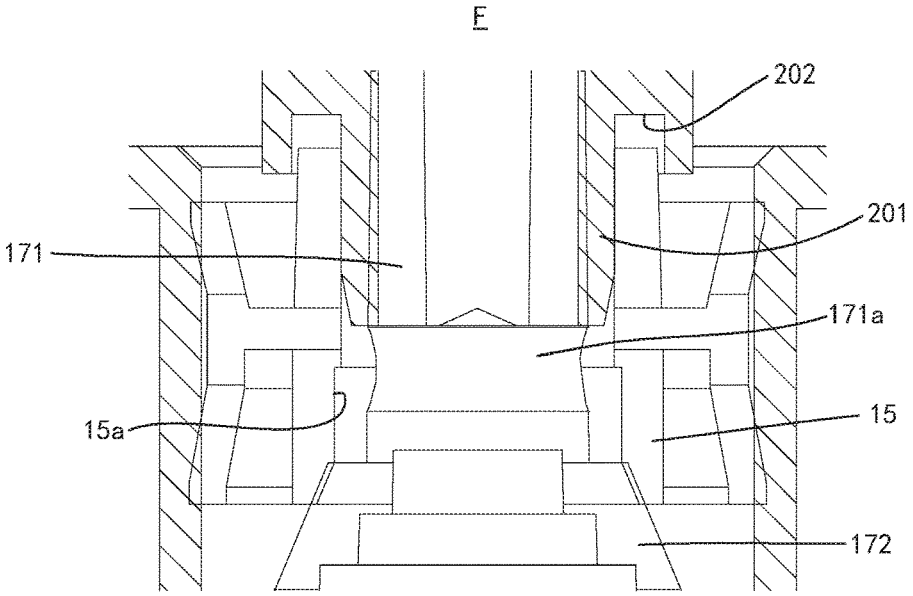
FIG. 26 is an enlarged view of part F in FIG. 25.

Referring first to FIGS. 25 and 26, the press rod 2 is in a pressing-down start position. The gas pressures in the first gas cavity 12*a* and the second gas cavity 12*b* may be equal, and may be both the atmospheric pressure. The second cavity 1*b* contains the contents 800 or air, the piston 15 is separated from the limiting face 202 and abuts against the seat portion 172, and the through hole 15*a* is in a closed state. The tapered body 160 of the valve 16 is fitted to the tapered face of the opening 112*a* such that the opening 112*a* is in a closed state. The press rod 2 is subjected to an external force to start to be pressed down from the pressing-down start position.

Figure 27:
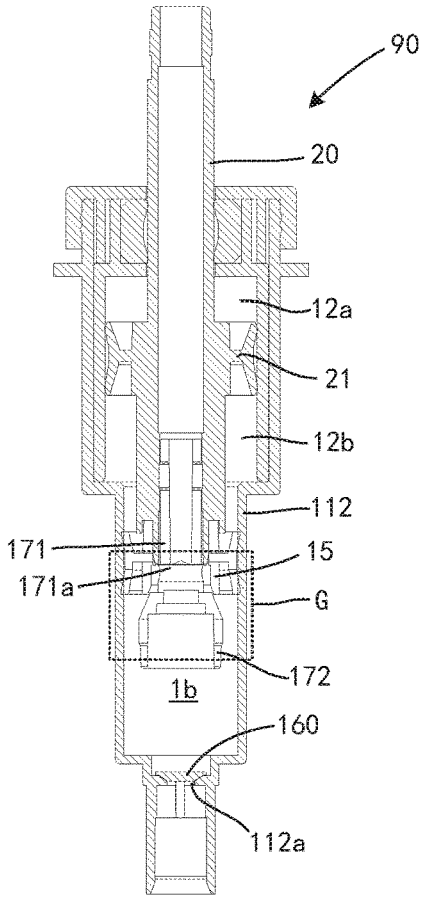
FIG. 27 is a sectional view of the pump assembly, in which the press rod is in a pressing-down midway position.
Figure 28:
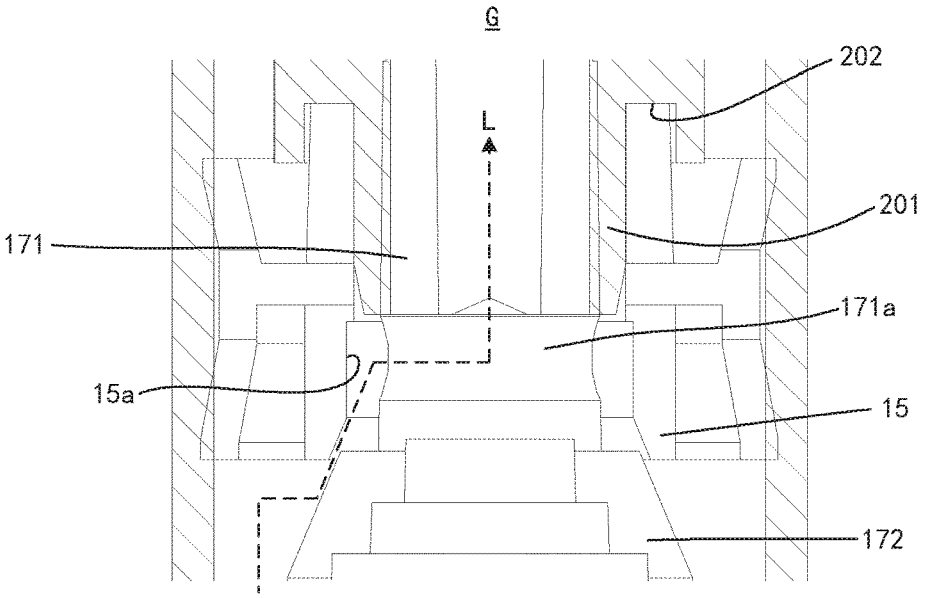
FIG. 28 is an enlarged view of part G in FIG. 27.

Then, referring to FIGS. 27 and 28, the press rod 2 is in a pressing-down midway position. As the press rod 2 is pressed down, the pressure of the gas in the first gas cavity 12*a* starts to decrease, the pressure of the gas in the second gas cavity 12*b* is equal to the atmospheric pressure, and a gas pressure difference is generated between the first gas cavity 12*a* and the second gas cavity 12*b*. In such a process, since the piston 15 is affected by the frictional force from the inner wall of the second housing portion 112, the piston 15 slides on the protruding column 201 in the direction away from the seat portion 172, and is separated from the seat portion 172, such that the through hole 15*a* is opened. The tapered body 160 of the valve 16 is fitted to the tapered face of the opening 112*a* such that the opening 112*a* is in the closed state.

The piston 15 slides in the direction away from the seat portion 172 until abutting against the limiting face 202, the piston 15 then starts to be driven by the rod body 20 to move downwardly, to compress the contents 800 or air in the second cavity 1*b*. Since the through hole 15*a* is in the open state and the opening 112*a* is in the closed state, the contents 800 or air in the second cavity 1*b* can pass through the through hole 15*a*, the flow guide channel 171*a*, the discharge channel 20*a*, and the dispensing channel 93*a* in sequence and then be discharged out of the second cavity 1*b*. The discharge path of the contents 800 or air in the second cavity 1*b* is shown by a dashed arrow L in FIG. 28.

Figure 29:
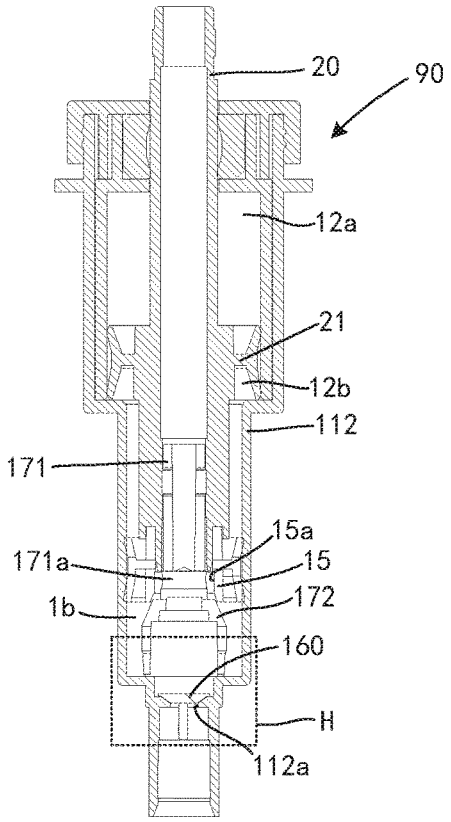
FIG. 29 is a sectional view of the pump assembly, in which the press rod is in a pressing-down end position.
Figure 30:
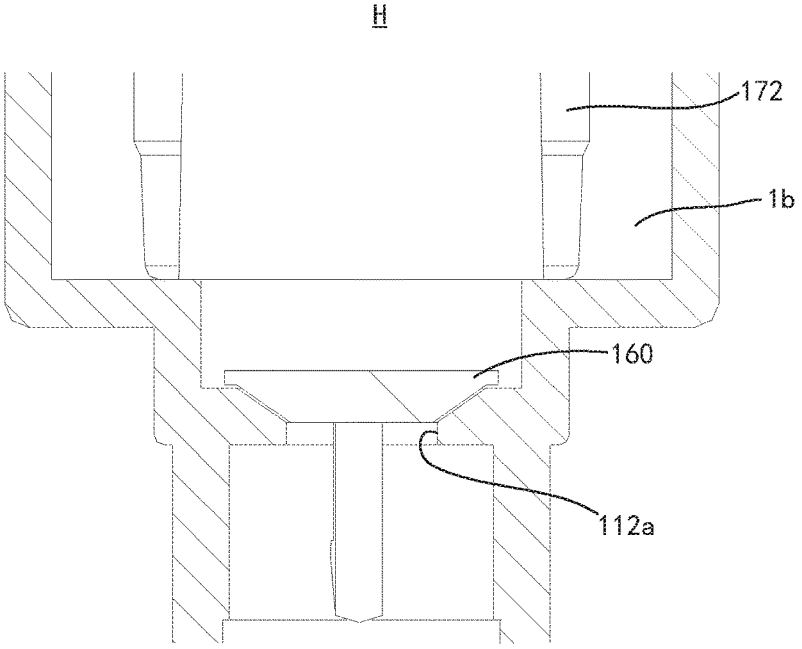
FIG. 30 is an enlarged view of part H in FIG. 29.

Then, referring to FIGS. 29 and 30, the press rod 2 is in a pressing-down end position. Now, the contents 800 or air in the second cavity 1*b* has been discharged out of the second cavity 1*b* to the maximum extent. The pressure of the gas in the first gas cavity 12*a* is reduced to a minimum value, and the gas pressure difference between the first gas cavity 12*a* and the second gas cavity 12*b* reaches a maximum value. The through hole 15*a* is still in the open state, and the opening 112*a* is still in the closed state. After the external force is withdrawn from the press rod 2, the piston portion 21 can rebound under the action of the resultant force of the gas pressure in the first gas cavity 12*a* and the gas pressure in the second gas cavity 12*b*, so as to drive the press rod 2 to start to rebound from the pressing-down end position.

Figure 31:
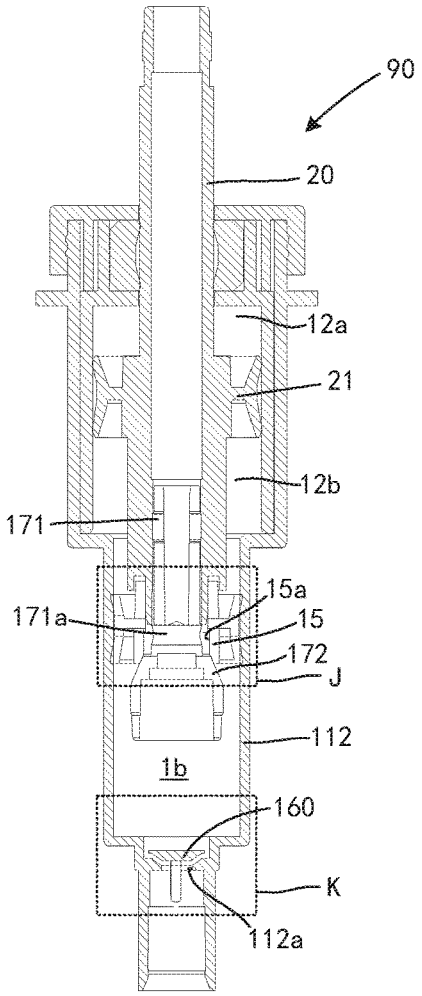
FIG. 31 is a sectional view of the pump assembly, in which the press rod is in a rebounding midway position.
Figure 32:
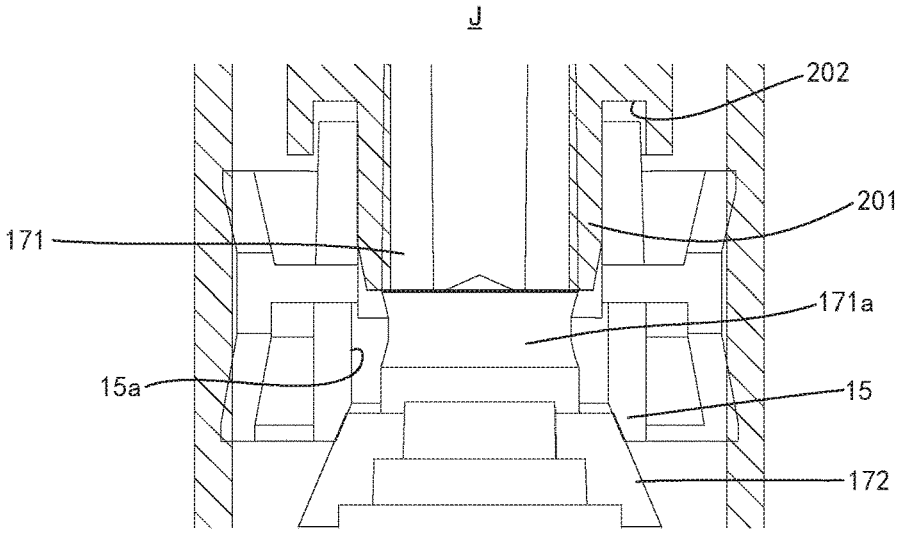
FIG. 32 is an enlarged view of part J in FIG. 31.
Figure 33:
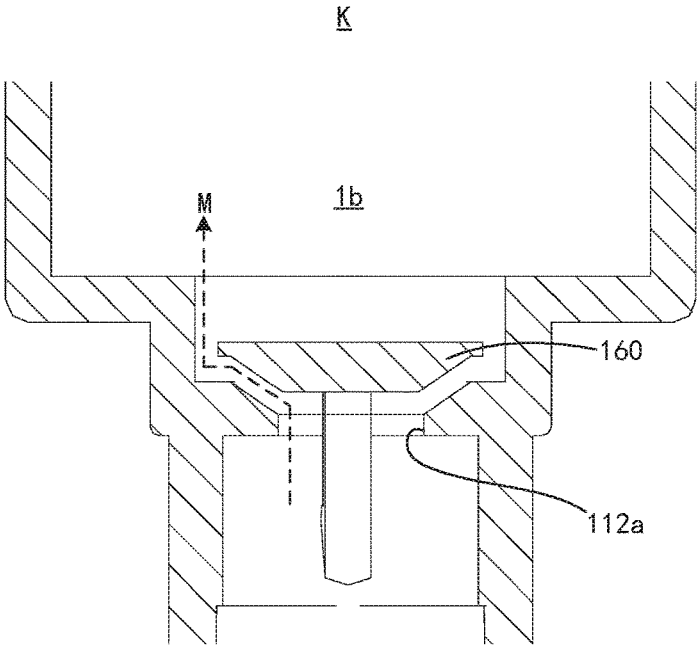
FIG. 33 is an enlarged view of part K in FIG. 31.

Finally, referring to FIGS. 31, 32 and 33, the press rod 2 is in a rebounding midway position. As the press rod 2 rebounds, the pressure of the gas in the first gas cavity 12*a* starts to increase, the pressure of the gas in the second gas cavity 12*b* is equal to the atmospheric pressure, and there is still a gas pressure difference between the first gas cavity 12*a* and the second gas cavity 12*b*. In such a process, since the piston 15 is affected by the frictional force from the inner wall of the second housing portion 112, the piston 15 slides on the protruding column 201 in the direction close to the seat portion 172, is separated from the limiting face 202 and abuts against the seat portion 172, such that the through hole 15*a* is closed. The tapered body 160 of the valve 16 is separated from the opening 112*a* such that the opening 112*a* is in the open state.

The piston 15 slides in the direction close to the seat portion 172 until abutting against the seat portion 172, the piston 15 is driven by the seat portion 172 to move upwardly, to increase the volume of the second cavity 1*b*. Since the through hole 15*a* is in the closed state and the opening 112*a* is in the open state, the contents 800 or air in the container body 91 can be sucked into the second cavity 1*b* through the opening 112*a*. The path for the contents 800 or air in the container body 91 to be sucked into the second cavity 1*b* through the opening 112*a* is shown by a dashed arrow M in FIG. 33.

The press rod 2 can rebound to the pressing-down start position shown in FIGS. 25 and 26 such that the press rod 2 is adapted to be re-pressed. During the multiple pressing and rebounding processes of the press rod 2, the contents 800 or air in the container body 91 is discharged out of the container body 91.

The present invention has been disclosed above in terms of the preferred embodiments which, however, are not intended to limit the present invention, and any person skilled in the art could make possible changes and alterations without departing from the spirit and scope of the present invention. Any alterations, equivalent changes and modifications which are made to the above-mentioned embodiments in accordance with the technical substance of the present invention and without departing from the content of the technical solutions of the present invention, shall fall within the scope of protection defined by the claims of the present invention.

The invention claimed is:

1. A pump assembly adapted to be mounted on a container body, which comprises a pump main body and a press rod, wherein the press rod has a rod body and a piston portion; the pump main body has a first cavity;

the rod body is slidably provided in the first cavity in a penetrating manner, and one end thereof extends out of the first cavity; the piston portion is connected to the rod body and is located in the first cavity so as to divide the first cavity into a first gas cavity and a second gas cavity;

the rod body is configured to be pressed to drive the piston portion to expand the first gas cavity and compress the second gas cavity; and the piston portion is configured to rebound under an action of a resultant force of a gas pressure in the first gas cavity and a gas pressure in the second gas cavity, so as to drive the rod body to rebound, such that the rod body is adapted to be re-pressed;

wherein the first gas cavity is a sealed cavity; the pump main body further has a gas guide channel, wherein the gas guide channel is in communication with the second gas cavity; and a gas is discharged from or sucked into the second gas cavity through the gas guide channel; and wherein the pump main body comprises an outer housing and an inner housing; the outer housing surrounds the inner housing, an inner wall of the inner housing defines the first cavity, and the piston portion is in a sliding fit with an inner wall of the inner housing; the inner housing is provided with a first access hole, the first access hole being in communication with the first cavity; the rod body is slidably provided in the first access hole in a penetrating manner; an outer wall of the inner housing is fitted to an inner wall of the outer housing in a surface-to-surface contact manner, wherein the inner wall of the outer housing is recessed to form the gas guide channel.

2. The pump assembly according to claim 1, wherein the inner housing has a top wall and a side wall, the top wall and the side wall defining the first cavity;

the piston portion is in a sliding fit with an inner wall of the side wall, and an outer wall of the side wall is fitted to the inner wall of the outer housing in a surface-to-surface contact manner; and the top wall has the first access hole.

3. The pump assembly according to claim 2, wherein the pump main body further comprises a sealing ring and a press cover; the sealing ring has an assembling hole, and the press cover has a second access hole;

the inner housing further has an annular wall, the annular wall being provided on an outer wall of the top wall in a protruding manner and surrounding the first access hole; the annular wall defines an accommodation cavity, the accommodation cavity being in communication with the first access hole;

the sealing ring is arranged in the accommodation cavity, and the assembling hole and the rod body are in a shaft-hole fit; the rod body is slidably provided in the second access hole in a penetrating manner; and the press cover is connected to the outer housing, to press the sealing ring against the top wall such that the sealing ring seals a gap between the first access hole and the rod body.

4. The pump assembly according to claim 1, wherein the pump main body further comprises a piston; the outer housing has a first housing portion and a second housing portion; the first housing portion surrounds the inner housing, the outer wall of the inner housing is fitted to an inner wall of the first housing portion in a surface-to-surface contact manner, and the inner wall of the first housing portion is recessed to form the gas guide channel; an inner wall of the second housing portion defines a second cavity;

the piston is arranged in the second cavity, and is in a sliding fit with the inner wall of the second housing portion; the other end of the rod body extends into the second cavity; and the rod body is configured to drive the piston to slide in the second cavity.

5. The pump assembly according to claim 4, wherein the pump main body further comprises a valve; the second housing portion has an opening, the opening being in communication with the second cavity; and the valve covers the opening, allowing the second cavity to suck in contents from the container body through the opening in one direction.

6. The pump assembly according to claim 4, wherein the piston has a through hole, and the rod body has a discharge channel, the discharge channel penetrating the rod body;

the discharge channel is in communication with the through hole; and the piston is configured to press the contents from the second cavity into the through hole, and discharge contents out of the second cavity through the discharge channel.

7. The pump assembly according to claim 6, wherein the pump main body further comprises a seat, the seat having a flow guide portion and a seat portion, wherein the flow guide portion is connected to the rod body, and the seat portion is provided in the second cavity;

the flow guide portion has a flow guide channel, one end of the flow guide channel is in communication with the discharge channel, and the other end thereof is in communication with the through hole; and the piston is slidably arranged on the rod body, wherein the piston is capable of sliding on the rod body in a direction away from the seat portion, so as to be separated from the seat portion, such that the through hole is opened; and the piston is also capable of sliding on the rod body in a direction close to the seat portion, so as to abut against the seat portion, such that the through hole is closed.

8. A container with a contents discharge function, which comprises a container body, wherein the container further comprises a pump assembly according to claim 1, the pump assembly being mounted on the container body and configured to discharge contents of the container body.

9. A pump assembly adapted to be mounted on a container body, which comprises a pump main body and a press rod, wherein the press rod has a rod body and a piston portion; the pump main body has a first cavity;

the rod body is slidably provided in the first cavity in a penetrating manner, and one end thereof extends out of the first cavity; the piston portion is connected to the rod body and is located in the first cavity so as to divide the first cavity into a first gas cavity and a second gas cavity;

the rod body is configured to be pressed to drive the piston portion to expand the first gas cavity and compress the second gas cavity; and the piston portion is configured to rebound under an action of a resultant force of a gas pressure in the first gas cavity and a gas pressure in the second gas cavity, so as to drive the rod body to rebound, such that the rod body is adapted to be re-pressed;

wherein the first gas cavity is a sealed cavity; the pump main body further has a gas guide channel, wherein the gas guide channel is in communication with the second gas cavity; and a gas is discharged from or sucked into the second gas cavity through the gas guide channel; and wherein the pump main body comprises an outer housing and an inner housing; the outer housing surrounds the inner housing, an inner wall of the inner housing defines the first cavity, and the piston portion is in a sliding fit with an inner wall of the inner housing; the inner housing is provided with a first access hole, the first access hole being in communication with the first cavity; the rod body is slidably provided in the first access hole in a penetrating manner; an outer wall of the inner housing is fitted to an inner wall of the outer housing in a surface-to-surface contact manner, wherein the gas guide channel is provided as a recess between the inner wall of the outer housing and the outer wall of the inner housing.

10. The pump assembly according to claim 9, wherein the inner wall of the outer housing is recessed to form the gas guide channel.

11. The pump assembly according to claim 9, wherein the inner housing has a top wall and a side wall, the top wall and the side wall defining the first cavity;

the piston portion is in a sliding fit with an inner wall of the side wall, and an outer wall of the side wall is fitted to the inner wall of the outer housing in a surface-to-surface contact manner; and the top wall has the first access hole.

12. The pump assembly according to claim 11, wherein the pump main body further comprises a sealing ring and a press cover; the sealing ring has an assembling hole, and the press cover has a second access hole;

the inner housing further has an annular wall, the annular wall being provided on an outer wall of the top wall in a protruding manner and surrounding the first access hole; the annular wall defines an accommodation cavity, the accommodation cavity being in communication with the first access hole;

the sealing ring is arranged in the accommodation cavity, and the assembling hole and the rod body are in a shaft-hole fit; the rod body is slidably provided in the second access hole in a penetrating manner; and the press cover is connected to the outer housing, to press the sealing ring against the top wall such that the sealing ring seals a gap between the first access hole and the rod body.

13. The pump assembly according to claim 9, wherein the pump main body further comprises a piston; the outer housing has a first housing portion and a second housing portion; the first housing portion surrounds the inner housing, the outer wall of the inner housing is fitted to an inner wall of the first housing portion in a surface-to-surface contact manner, and the inner wall of the first housing portion is recessed to form the gas guide channel; an inner wall of the second housing portion defines a second cavity;

the piston is arranged in the second cavity, and is in a sliding fit with the inner wall of the second housing portion; the other end of the rod body extends into the second cavity; and the rod body is configured to drive the piston to slide in the second cavity.

14. The pump assembly according to claim 13, wherein the pump main body further comprises a valve; the second housing portion has an opening, the opening being in communication with the second cavity; and the valve covers the opening, allowing the second cavity to suck in contents from the container body through the opening in one direction.

15. The pump assembly according to claim 13, wherein the piston has a through hole, and the rod body has a discharge channel, the discharge channel penetrating the rod body;

the discharge channel is in communication with the through hole; and the piston is configured to press the contents from the second cavity into the through hole, and discharge contents out of the second cavity through the discharge channel.

16. The pump assembly according to claim 15, wherein the pump main body further comprises a seat, the seat having a flow guide portion and a seat portion, wherein the flow guide portion is connected to the rod body, and the seat portion is provided in the second cavity;

the flow guide portion has a flow guide channel, one end of the flow guide channel is in communication with the discharge channel, and the other end thereof is in communication with the through hole; and the piston is slidably arranged on the rod body, wherein the piston is capable of sliding on the rod body in a direction away from the seat portion, so as to be separated from the seat portion, such that the through hole is opened; and the piston is also capable of sliding on the rod body in a direction close to the seat portion, so as to abut against the seat portion, such that the through hole is closed.

17. A container with a contents discharge function, which comprises a container body, wherein the container further comprises a pump assembly according to claim 9, the pump assembly being mounted on the container body and configured to discharge contents of the container body.

* * * * *